US006043599A

United States Patent [19]

Nakane

[11] Patent Number: 6,043,599

[45] Date of Patent: Mar. 28, 2000

[54] CATHODE RAY TUBE DEVICE AND METHOD FOR MAKING A CONDUCTIVE FILM ON A FUNNEL

[75] Inventor: Takayuki Nakane, Tokyo, Japan

[73] Assignee: Mitsubishi Denki Kabushiki Kaisha, Tokyo, Japan

[21] Appl. No.: 08/748,914

[22] Filed: Nov. 13, 1996

[30] Foreign Application Priority Data

Nov. 29, 1995 [JP] Japan ..... 7-311155

[51] Int. Cl.[7] ..... H01J 31/00; H01J 29/70; H01J 1/52; H01J 5/02

[52] U.S. Cl. ..... 313/479; 313/440; 313/477 R; 315/85

[58] Field of Search ..... 313/461, 466, 313/473, 477 R, 478–79, 421, 426–30, 440; 335/210, 212, 213, 296–97, 299; 315/8, 85; 348/818; 358/254

[56] References Cited

U.S. PATENT DOCUMENTS

| | | |
|---|---|---|
| 5,300,856 | 4/1994 | Bartch et al. . |
| 5,304,891 | 4/1994 | Otsuka . |
| 5,357,166 | 10/1994 | Sugihara et al. . |
| 5,451,840 | 9/1995 | Abe et al. . |

FOREIGN PATENT DOCUMENTS

| | | |
|---|---|---|
| 1003359 | 2/1957 | Germany . |
| 5-74374 | 3/1993 | Japan . |
| 6-275191 | 9/1994 | Japan . |
| 899119 | 12/1989 | Rep. of Korea . |

OTHER PUBLICATIONS

Patent Abstracts of Japan, vol. 006, No. 107 (E–113), Jun. 17, 1982—Abstract for JP 57–038534A, published Mar. 3, 1982.

Patent Abstracts of Japan, vol. 015, No. 106 (E–1044), Mar. 13, 1991—Abstract for JP 02–312135A, published Dec. 27, 1990.

Patent Abstracts of Japan. vol. 007, No. 065 (E–165), Mar. 18, 1983—Abstract for JP 57–212736A, published Dec. 27, 1982.

*Primary Examiner*—Nimeshkumar D. Patel
*Assistant Examiner*—Mack Haynes

[57] ABSTRACT

A cathode ray tube device has a neck, a funnel, a face panel, an inner conductive film disposed on an inner surface of the funnel, a first outer conductive film disposed on an outer surface of the funnel, and a deflection yoke. The inner conductive film and the first outer conductive film act as a capacitor. A second outer conductive film for electric field shielding is disposed on an outer surface of the funnel. The second conductive film is disposed between the deflection yoke and the first outer conductive film in such a way that the second outer conductive film is separated from the deflection yoke and is not covered by the deflection yoke.

9 Claims, 5 Drawing Sheets

CATHODE RAY TUBE DEVICE AND METHOD FOR MAKING A CONDUCTIVE FILM ON A FUNNEL

BACKGROUND OF THE INVENTION

The present invention relates to a cathode ray tube device designed to reduce the alternating electric field emitted from the deflection yoke by providing a conductive film for electric field shielding on a funnel and a method for making the conductive film.

In recent years, there has been public concern for health hazards from electromagnetic waves. As for the, display monitor, the ill effect of the alternating electric field emitted mainly from the deflection yoke, that is, radial electric field extending from the deflection yoke, on human bodies is worried.

Countermeasures against the alternating electric field are disclosed in, for example, U.S. Pat. Nos. 5,357,166 and 5,304,891. In these publications, a conductive film for electric field shielding is formed on a glass bulb from a neck portion to a cone portion, and the deflection yoke is mounted on the conductive film via an insulation sheet interposed therebetween.

However, the insulating performance of the insulation sheet may deteriorate as time goes by.

Further, the insulation sheet narrows a gap between the cone portion and the deflection yoke and makes it difficult to insert a spoiler for convergence adjustment into the gap. The narrow gap also results in poor heat dissipation of the deflection yoke, raising the temperature in the deflection yoke and increasing the electric power loss.

Furthermore, the effect of the cost of the insulation sheet is not negligible.

SUMMARY OF THE INVENTION

It is an object of the present invention to provide a cathode ray tube device which can reduce the ill effect of the alternating electric field on human bodies without using an insulation sheet.

It is another object of the present invention to provide a method for making a conductive film for electric field shielding on a funnel using a simple process.

According to the present invention, the cathode ray tube device comprises a neck containing an electron gun; a funnel including a main body portion and a cone portion provided between the neck and the main body portion; a face panel connected to the main body portion and having a phosphor screen; an inner conductive film disposed on an inner surface of the funnel; a first outer conductive film disposed on an outer surface of the funnel, the inner conductive film and the first outer conductive film acting as a capacitor; a deflection yoke mounted around the neck and the cone portion; and a second outer conductive film for electric field shielding disposed on an outer surface of the funnel; wherein the second conductive film is disposed between the deflection yoke and the first outer conductive film in such a way that the second outer conductive film is separated from the deflection yoke and is not covered by the deflection yoke.

Further, according to the present invention, a method for making a conductive film on a surface of a funnel of a cathode ray tube device, comprises the steps of: holding the funnel so as to be able to turn on a tube axis of the cathode ray tube; pressing an applying means for applying conductive material against the surface of the funnel; and turning the funnel on the tube axis. A portion of the funnel, which is in contact with the applying means, is included in a plane including the tube axis.

DETAILED DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Preferred embodiments of the present invention will be described with reference to the accompanying drawings.

First Embodiment

Figure 1:
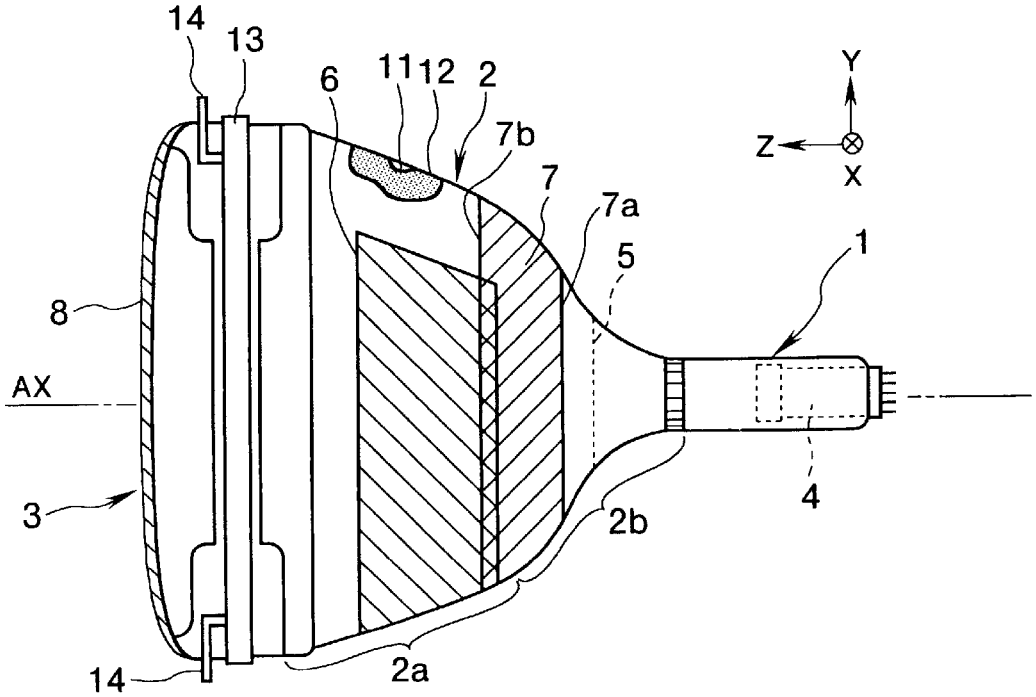
FIG. 1 is a side view of a cathode ray tube device without a deflection yoke according to a first embodiment of the present invention.
Figure 2:
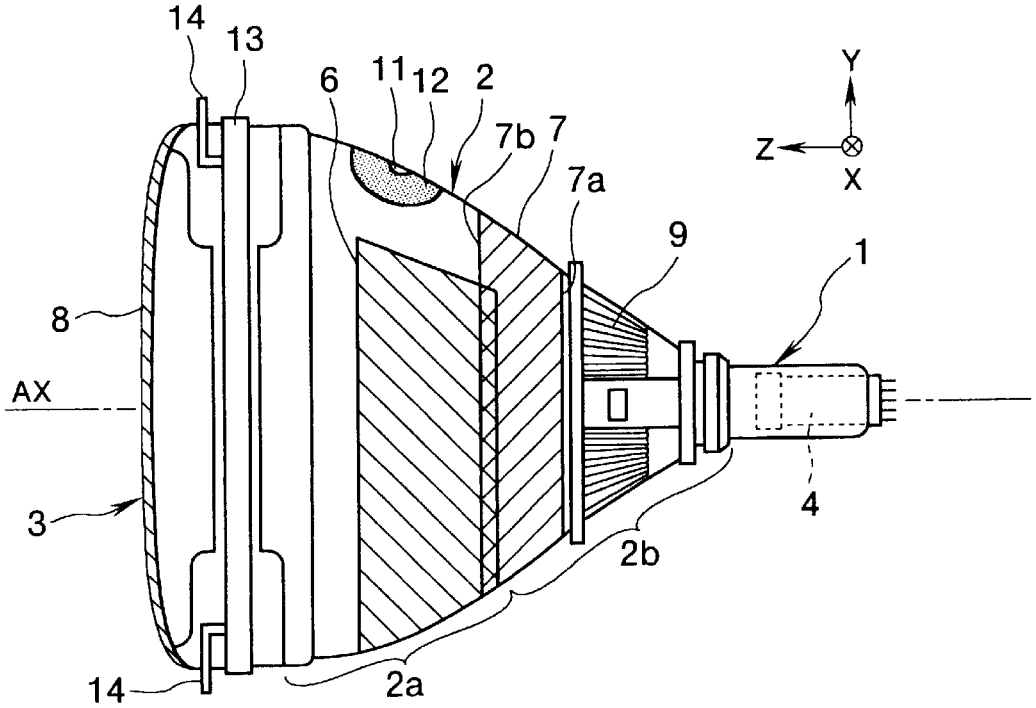
FIG. 2 is a side view of the cathode ray tube device with the deflection yoke according to the first embodiment.
Figure 3:
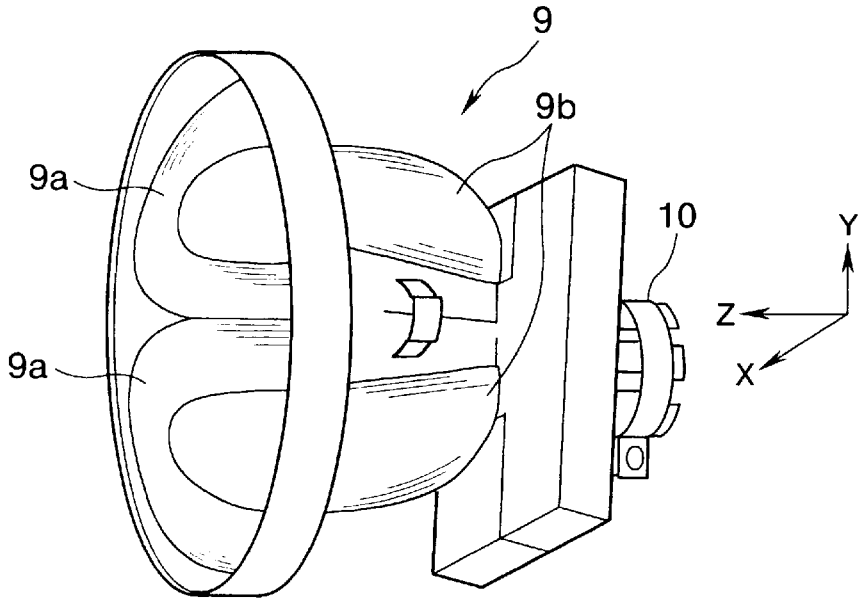
FIG. 3 is a perspective view of the deflection yoke shown in FIG. 2.

FIG. 1 is a side view of a cathode ray tube device before a deflection yoke is mounted, according to the first embodiment of the present invention, FIG. 2 is a side view of the cathode ray tube device of FIG. 1 after the deflection yoke is mounted, and FIG. 3 is a perspective view of the deflection yoke shown in FIG. 2. In the figures, X denotes a horizontal direction, Y denotes a vertical direction perpendicular to the X direction, and Z denotes a horizontal direction perpendicular to the X and Y directions and parallel to a tube axis AX of a glass bulb.

As shown in FIG. 1, the cathode ray tube device of the first embodiment comprises a glass neck 1, a glass funnel 2 including a main body portion 2*a* and a cone portion 2*b* provided between the neck 1 and the main body portion 2*a*, and a glass face panel 3 connected to the main body portion 2*a*. The neck 1, the funnel 2 and the face panel 3 compose the glass bulb.

The neck 1 contains an electron gun 4 for emitting electron beams toward the face panel 3.

The funnel 2 is provided with an inner conductive film 5 coated on an inner surface of the main body portion 2*a* and the cone portion 2*b*, and a first outer conductive film 6 coated on an outer surface of the main body portion 2*a* and electrically connected to the ground chassis (not shown in the figures). The first outer conductive film 6 is usually formed by applying graphite and is not necessarily continuous in a microscopic view. The inner conductive film 5 and the first outer conductive film 6 face each other via the funnel 2 as dielectric, and act as a capacitor.

The funnel 2 is also provided with a second outer conductive film 7 for electric field shielding coated on the outer surface of the main body portion 2*a* and the cone portion 2*b*. The second outer conductive film 7 as a whole is substantially in the shape of a hollow frustum of cone, an axis of which coincides with the tube axis AX of the glass bulb.

The face panel 3 is provided with a phosphor screen (not shown in the figures) on an inner surface and a grounded transparent conductive coating 8 for electric field shielding disposed on an outer surface.

As shown in FIGS. 2 and 3, the cathode ray tube device of the first embodiment further comprises a deflection yoke 9 mounted around the neck 1 and the cone portion 2*b*. As shown in FIG. 3, the deflection yoke 9 includes a horizontal deflection coil 9*a* and a vertical deflection coil 9*b* and is mounted on the neck 1 by clamping a mounting band 10. Between the deflection yoke 9 and the cone portion 2*b*, a gap for adjusting the convergence characteristics, which is called a self-convergence system, is provided. The deflection yoke 9 is rotated about the mounting band 10 to adjust the gap. This gap is important, for a narrow plastic plate having ferrite sheet at the end (hereafter called a spoiler) is inserted for adjusting convergence in finer increments than in self-convergence adjustment.

The second outer conductive film 7 is disposed between the deflection yoke 9 and the first outer conductive film 6 in such a way that the second outer conductive film 7 is separated from the deflection yoke 9 and is not covered by the deflection yoke 9. One end 7*a* of the second outer conductive film 7 is in the vicinity of a horizontal deflection coil 9*a* of the deflection yoke 9 so as to keep such a distance that no discharge will occur between the second outer conductive film 7 and the horizontal deflection coil 9*a* of the deflection yoke 9. The other end 7*b* of the second outer conductive film 7 is disposed to partly cover the first conductive film 6 or be partly covered by the first conductive film 6 so that the first and second outer conductive films 6 and 7 are electrically connected.

Figure 4:
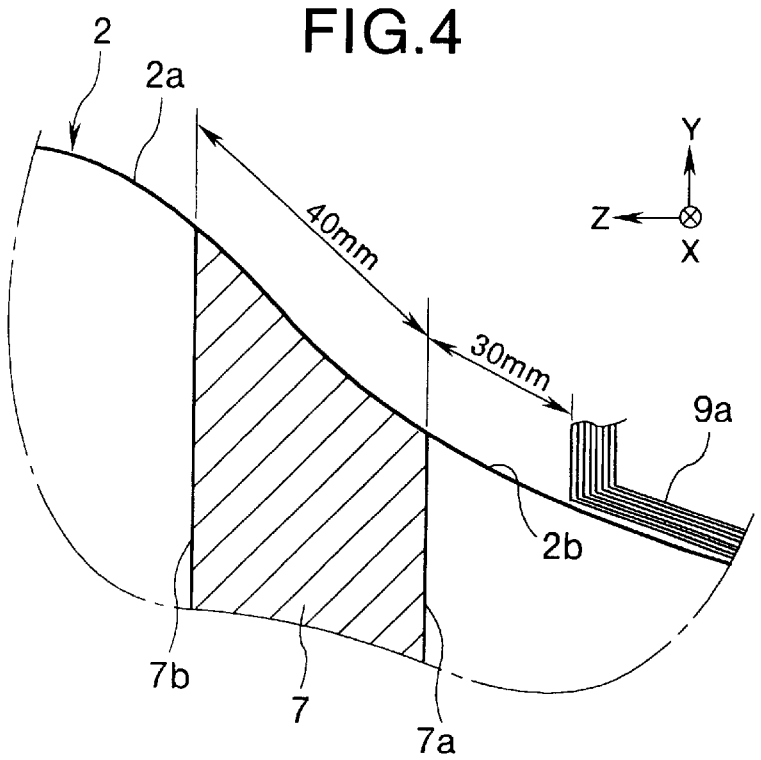
FIG. 4 shows the relation in position between the second outer conductive film and the horizontal deflection coil according to the first embodiment.

FIG. 4 shows the relation in position between the second outer conductive film 7 and the horizontal deflection coil 9*a* of the deflection yoke 9. As shown in FIG. 4, the end 7*a* of the second outer conductive film 7 on the side of the deflection yoke 9 is disposed about 30 [mm] from the front end of the horizontal deflection coil 9*a*, measured along the outer surface of the cone portion 2*b*. The width of the second outer conductive film 7 is set to 40 [mm], measured from the one end 7*a* on the side of the deflection yoke 9 to the other end 7*b* on the side of the face panel 3 along the outer surface of the funnel 2.

Further, in the figures, a numeral 11 denotes a high-voltage anode button, 12 denotes a silicon resin coating for insulation, 13 denotes a tension band tied around the face panel 3 for preventing an implosion of the glass bulb, and 14 denotes hooks for hanging the glass bulb on a housing (not shown in the figures) at the four corners.

The operation will next be described. In the cathode ray tube device configured as described above, the first outer conductive film 6 is grounded and becomes an equipotential surface of 0 [V]. Since there is electrical continuity between the first and second outer conductive films 6 and 7, the second outer conductive film 7 also becomes an equipotential surface of 0 [V]. Since an area in the vicinity of the deflection yoke 9 is coated by the second outer conductive film 7 functioning as electric field shielding, the alternating electric field spreading out from the deflection yoke 9 and passing through the funnel 2 and the face panel 3 is reduced.

Further, since the end 7*a* of the second outer conductive film 7 for electric field shielding on the side of the deflection yoke 9 is disposed so that no discharge will occur between the second outer conductive film 7 and the horizontal deflection coil 7*a*, the insulation sheet used in the conventional cathode ray tube device is no longer necessary. Therefore, a gap between the cone portion 2*b* and the deflection yoke 9 is large enough to insert a spoiler for convergence adjustment and a good heat dissipation of the deflection yoke 9 is possible.

The method for making the second outer conductive film 7 for electric field shielding will next be described with reference to FIG. 5. The second outer conductive film 7 is in the shape of a hollow frustum of cone, an axis of which coincides with the tube axis AX, with a circular end when seen from the side of deflection yoke 9. The cross-section of the funnel 2 perpendicular to the tube axis AX is also roughly circular. Since the second outer conductive film 7 for electric field shielding along the funnel 2 has a very large radius of curvature in the direction of width, applying process can be possible using the applying member which has some contraction and expansion properties.

In the first embodiment, the sponge rollers 15 are used as the applying member to apply the coating. The applying member may not always be the sponge roller 15, and a brush or the like can also be used.

Figure 5:
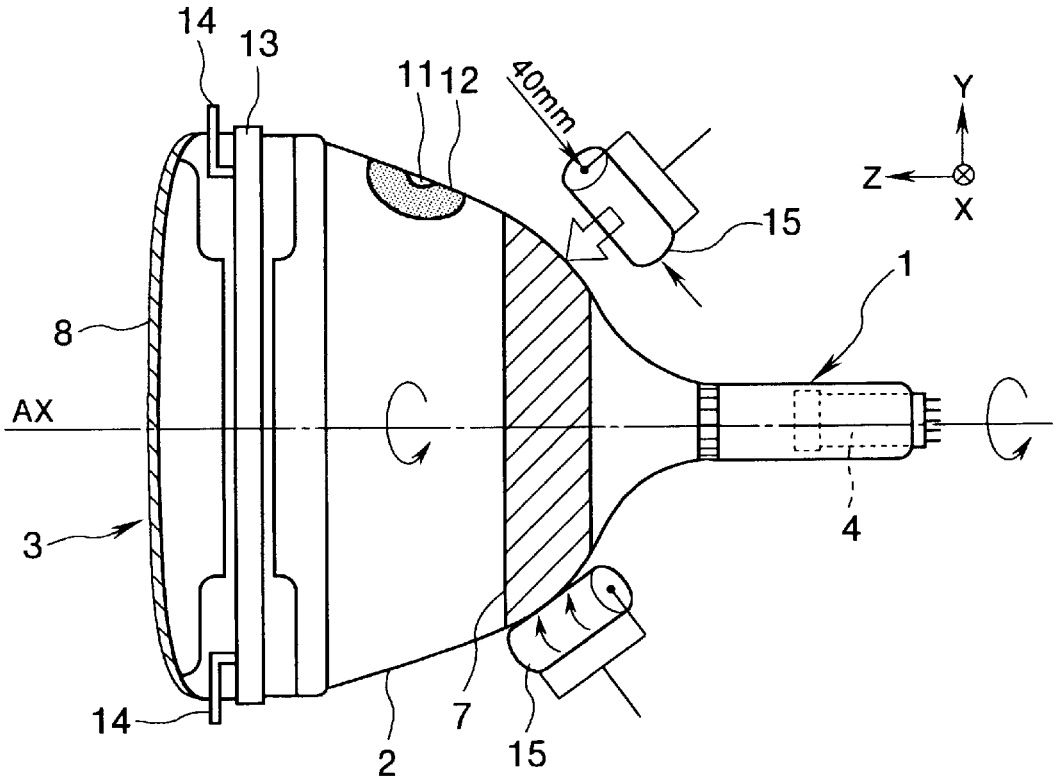
FIG. 5 shows how the second outer conductive film of FIG. 1 is formed on the funnel.

The sponge rollers 15 used in the first embodiment have the length that matches the width of the second outer conductive film 7 for electric field shielding (40 [mm] in the first embodiment), as shown in FIG. 5.

Next, the process of coating a conductive film is described.

First, the funnel 2 is held by a supporting device (not shown in the figures) so as to be able to turn the tube about the tube axis AX. Next, sponge rollers 15 are pressed for applying conductive material (for example, graphite) against the surface of the funnel 2. A portion of the funnel 2, which is in contact with the sponge rollers 15, is included in a plane including the tube axis AX. Next, the funnel 2 is turned about the tube axis AX. As described above, the second outer conductive film 7 for electric field shielding of a desired shape can be applied by not moving the sponge rollers 15 but by rotating the cathode ray tube about the tube axis 28.

Since the funnel-shaped second outer conductive film 7 can be formed by rotating the cathode ray tube while not moving the sponge rollers 15, the second outer conductive film 7 can be applied more quickly and accurately. Especially, the boundary of the applied area of the second outer conductive film 7 on the side of the deflection yoke 9 must be held to tolerances of ±5 [mm], in order to avoid discharge between the second outer conductive film 7 and the horizontal deflection coil 9*a*. The first embodiment can satisfy the tolerance requirements.

Further, by using the sponge rollers 15 as wide as the second outer conductive film 7, the boundary of the second conductive film 7 on the side of the deflection yoke 7 can be accurately positioned. Consequently, the other boundary on the side of the face panel 3 can be accurately positioned. Since the distance from the anode button 11 can also be accurately reproduced, the possibility of discharge between the anode button 11 and the second outer conductive film 7 need not be considered.

Second Embodiment

Figure 6:
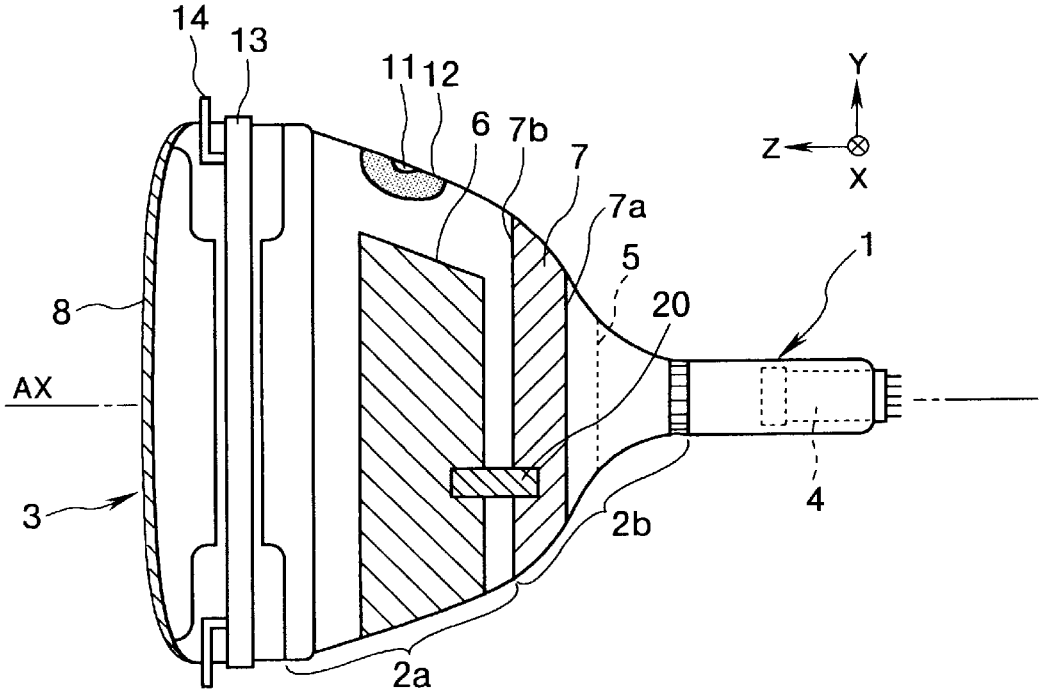
FIG. 6 is a side view of a cathode ray tube without a deflection yoke according to a second embodiment of the present invention.
Figure 7:
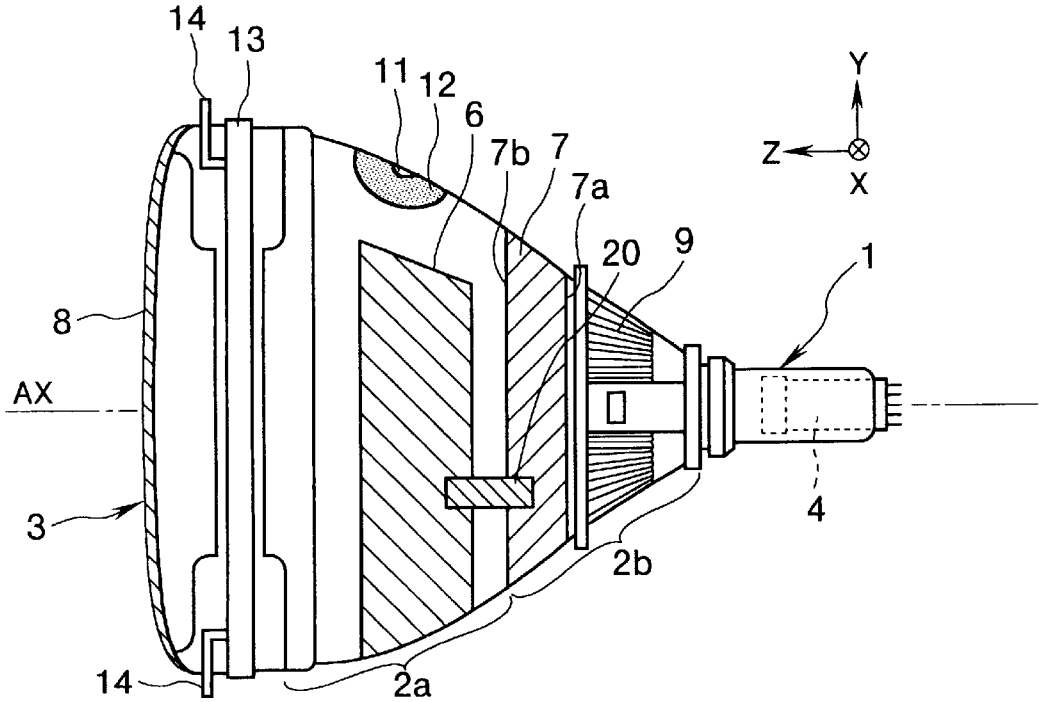
FIG. 7 is a side view of the cathode ray tube device with the deflection yoke according to the second embodiment.

FIG. 6 is a side view of a cathode ray tube device before a deflection yoke is mounted according to the second embodiment of the present invention, and FIG. 6 is a side view of the cathode ray tube device of FIG. 6 after the deflection yoke is mounted. In FIGS. 6 and 7, the same numerals are assigned to the elements corresponding to those in FIGS. 1 and 2.

The cathode ray tube device of the second embodiment is different from that of the first embodiment only in the respects that the second outer conductive film 7 is separated from the first outer conductive film 6, and a conductive tape 20 is provided on the outer surface of the funnel 2 and electrically connecting the second outer conductive film 7 with the first outer conductive film 6. Except for the points described above, the second embodiment is the same as the first embodiment.

Third Embodiment

Figure 8:
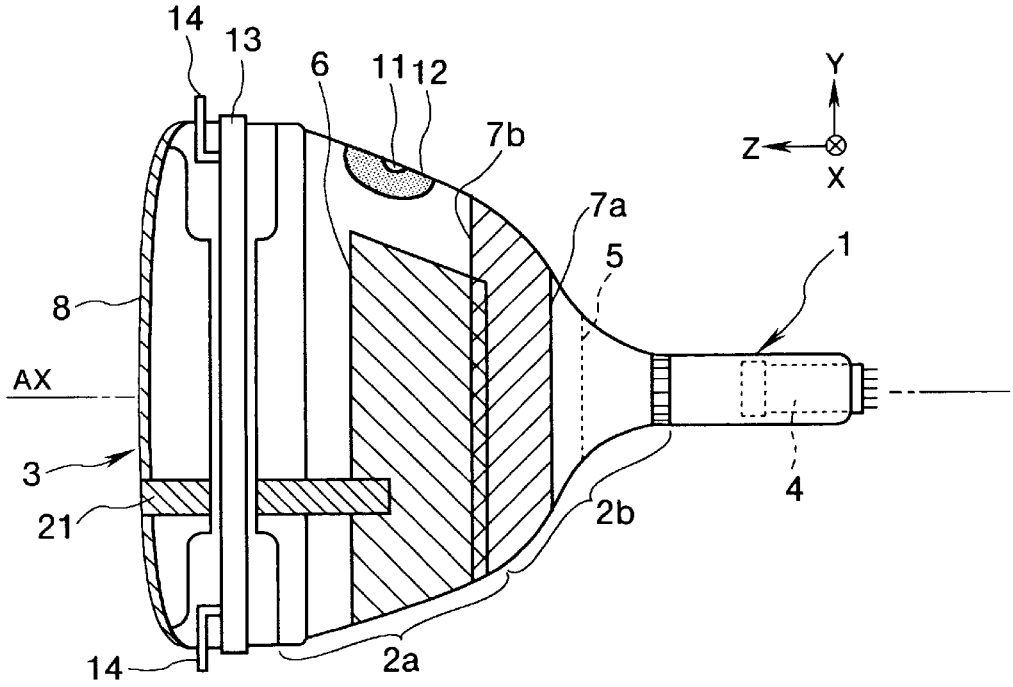
FIG. 8 is a side view of a cathode ray tube without a deflection yoke according to a third embodiment of the present invention.
Figure 9:
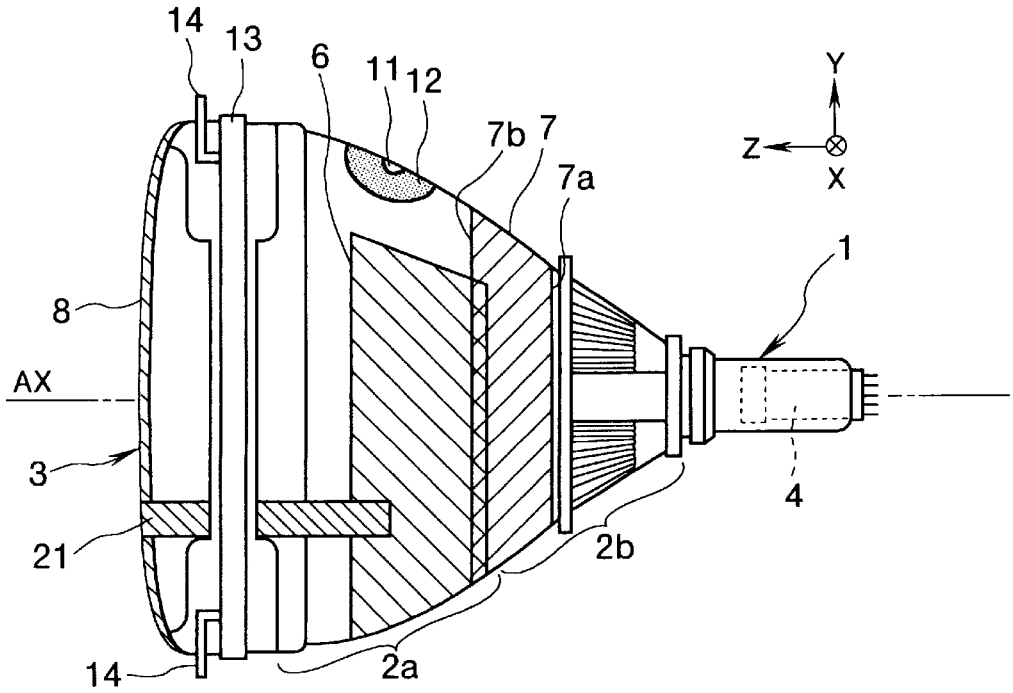
FIG. 9 is a side view of the cathode ray tube device with the deflection yoke according to the third embodiment.

FIG. 8 is a side view of a cathode ray tube device before a deflection yoke is mounted according to the third embodiment of the present invention, and FIG. 9 is a side view of the cathode ray tube device of FIG. 8 after the deflection yoke is mounted. In FIGS. 8 and 9, the same numerals are assigned to the elements corresponding to those in FIGS. 1 and 2.

The cathode ray tube device of the third embodiment is different from that of the first embodiment only in the respects that a conductive tape 21 is provided on the outer surface of the funnel 2 and electrically connecting the transparent conductive film 8 with the second outer conductive film 7. Except for the points described above, the third embodiment is the same as the first embodiment.

What is claimed is:

1. A cathode ray tube device, comprising:

a neck containing an electron gun;

a funnel including a main body portion and a cone portion provided between said neck and said main body portion;

a face panel connected to said main body portion and having a phosphor screen;

an inner conductive film disposed on an inner surface of said funnel;

a first outer conductive film disposed on an outer surface of said funnel, said inner conductive film and said first outer conductive film acting as a capacitor;

a deflection yoke mounted around said neck and said cone portion; and a second outer conductive film adapted to shield an electric field, said second outer conductive film being disposed on an outer surface of said funnel between said deflection yoke and said first outer conductive film in such a way that said deflection yoke does not overlap with any portion of said second outer conductive film.

2. The cathode ray tube device of claim 1, wherein said second outer conductive film as a whole is in the shape of a hollow frustum of cone.

3. The cathode ray tube device of claim 1, wherein one end of said second outer conductive film is in the vicinity of a horizontal deflection coil composing a part of said deflection yoke.

4. The cathode ray tube device of claim 3, wherein said first outer conductive film is grounded, and the other end of said second outer conductive film is in contact with said first outer conductive film.

5. The cathode ray tube device of claim 3, wherein said first outer conductive film is grounded, said cathode ray tube device further including a conductive tape disposed on said outer surface of said funnel and electrically connecting said second outer conductive film with said first outer conductive film.

6. The cathode ray tube device of claim 1, further comprising:

a grounded transparent conductive coating for electric field shielding disposed on an outer surface of said face panel.

7. A cathode ray tube device of claim 1, wherein said deflection yoke is electrically separated from said second outer conductive film such that no discharge occurs between said second outer conductive film and said deflection yoke.

8. A cathode ray tube device of claim 1, wherein said second outer conductive film has a width of about 40 mm.

9. A cathode ray tube device of claim 1, wherein a side of said second outer conductive film closer to said deflection yoke and a side of said deflection yoke closer to said second outer conductive film are separated by a distance of about 30 mm.

* * * * *